US005486148A

United States Patent [19]

Johnston

[11] Patent Number: 5,486,148

[45] **Date of Patent: * Jan. 23, 1996**

[54] FLEXIBLE CYCLING APPARATUS

[76] Inventor: Gary L. Johnston, P.O. Box 183, Cowarts, Ala. 36321

[ * ] Notice: The portion of the term of this patent subsequent to Aug. 30, 2011, has been disclaimed.

[21] Appl. No.: 223,714

[22] Filed: Apr. 6, 1994

Related U.S. Application Data

[63] Continuation-in-part of Ser. No. 131,396, Oct. 5, 1993, Pat. No. 5,342,261.

[51] Int. Cl.[6] ..... A63B 22/06

[52] U.S. Cl. ..... 482/57

[58] Field of Search ..... 482/57, 60, 51, 482/110, 63, 64, 65, 72–73, 908

[56] References Cited

U.S. PATENT DOCUMENTS

| | | | |
|---|---|---|---|
| 562,198 | 6/1896 | Robinson | 482/57 |
| 3,057,201 | 10/1962 | Taeger | 272/73 |
| 3,910,571 | 10/1975 | Stenn | 482/60 |
| 3,968,963 | 7/1976 | Sileo | 482/60 |
| 4,564,193 | 1/1986 | Stewart | 482/57 |
| 4,770,411 | 9/1988 | Armstrong et al. | 272/73 |
| 4,838,547 | 6/1989 | Sterling | 482/57 |
| 5,160,305 | 11/1992 | Lin | 482/57 |
| 5,232,422 | 8/1993 | Bishop | 482/57 |
| 5,342,261 | 8/1994 | Johnston | 482/57 |

*Primary Examiner*—Stephen R. Crow

[57] ABSTRACT

An adjustable cycling apparatus comprising a pedal mechanism which may be adjusted to various horizontal and vertical positions for a more versatile cycling exercise routine. The cycling apparatus includes a frame unit upon which the pedal mechanism is mounted. The pedal mechanism is collapseable into the frame unit for easy storage. The frame unit supports a seat with adjustable back and arm supports whereby cycling exercise routines may be performed from a comfortable seated position. The back and arm supports may also be lowered to add to the collapseability of the apparatus.

9 Claims, 4 Drawing Sheets

FLEXIBLE CYCLING APPARATUS

CROSS-REFERENCED TO RELATED APPLICATIONS

This application is a continuation-in-part of U.S. application Ser. No. 08/131,396, filed Oct. 5, 1993, and entitled "Adjustable Cycling Apparatus", now U.S. Pat. No. 5,342,261.

BACKGROUND OF THE INVENTION

1. Field of the Invention

The present invention relates to an exercise device and more particularly to a cycling apparatus with a position adjustable pedal mechanism.

2. Description of the Prior Art

Presently there exists many variations of home cycling devices designed specifically for indoor use. While these conventional devices offer a relatively effective means for providing cycling exercise, most are one dimensional, i.e. the pedal mechanism is always positioned at one location, with the pedal mechanism usually located substantially below the user. Also, most of the cycling units presently available are not very comfortable and may prove hard to balance upon. Other cycling units which have the pedal mechanism placed in front of the user are low to the ground, providing inadequate access for some people, such as those with physical disabilities. Cycling device which offer some adjustability are known.

U.S. Pat. No. 3,057,201 to Jaeger discloses a cycling device with a pedal unit which can only be adjusted about a single pivot point.

U.S. Pat. No. 4,770,411 to Armstrong discloses a cycling device which has an adjustable seat and a fixed position pedal unit.

U.S. Pat. No. 4,838,547 to Sterling discloses a cycling apparatus with a pedal unit which can be pivotally adjusted and folded under the frame for storage.

None of the above inventions and patents, taken either singly or in combination, is seen to describe the instant invention as claimed.

SUMMARY OF THE INVENTION

The present invention is a cycling apparatus, intended for indoor use, which comprises a structural frame unit and a pedal mechanism assembly unit.

The structural frame unit comprises an adjustable seat, from which the user operates the device, mounted on a rigid frame, and an assembly support for supporting and/or connecting the pedal mechanism assembly unit with the rigid frame.

The pedal mechanism assembly unit comprises a pedal assembly, resistance means, an assembly structure for supporting the pedal assembly and resistance means, and an attachment means for connecting the assembly unit with the assembly support of the structural frame unit. Optionally, an exercise data collection and display means, such as an exercise computer, may be attached.

The pedal mechanism assembly unit and the structural frame unit are moveably and pivotally coupled together so that the pedal assembly may be positioned at various horizontal, vertical, and angled alignments with respect to the structural frame unit, then reversible secured in place for the duration of the cycling routine.

Accordingly, it is a principle object of the invention to provide a cycling apparatus which is comfortable to operate and which allows the user to position a pedal mechanism at various horizontal, vertical, and angled positions thereby allowing for a versatile exercise cycling routine.

It is another object of the invention to provide a cycling apparatus which is collapseable into a more compact configuration to facilitate storage and transport.

It is a further object of the invention to provide improved elements and arrangements thereof in an apparatus for the purpose described which is inexpensive, dependable, and fully effective in accomplishing its intended purposes.

These and other objects of the present invention will become readily apparent upon further review of the following specification and drawings.

BRIEF DESCRIPTION OF DRAWING

Similar reference characters denote corresponding features consistently throughout the attached drawings.

DETAILED DESCRIPTION OF THE PREFERRED EMBODIMENT

Figure 1A:
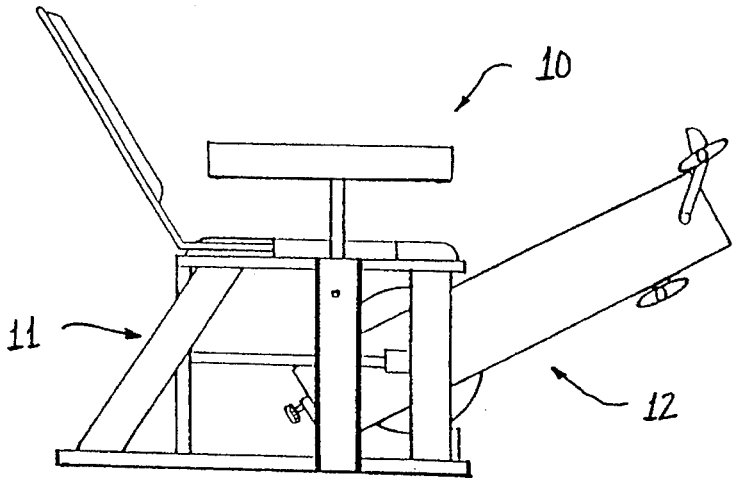
FIGS. 1A, 1B, and 1C are side view of the embodiment of the present apparatus.
Figure 1B:
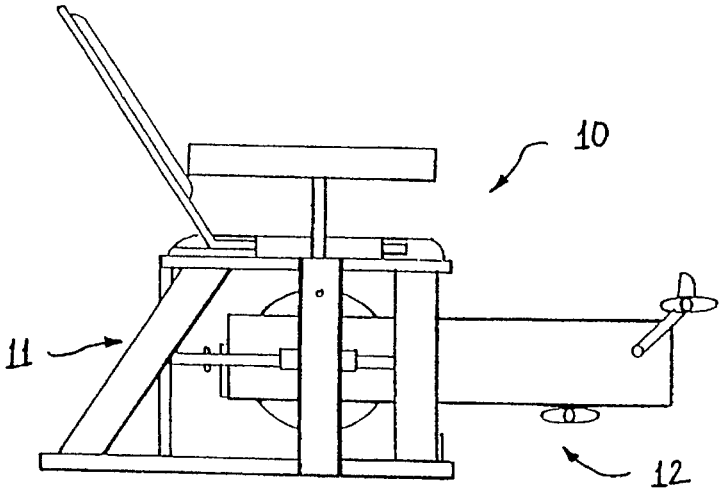
Figure 1C:
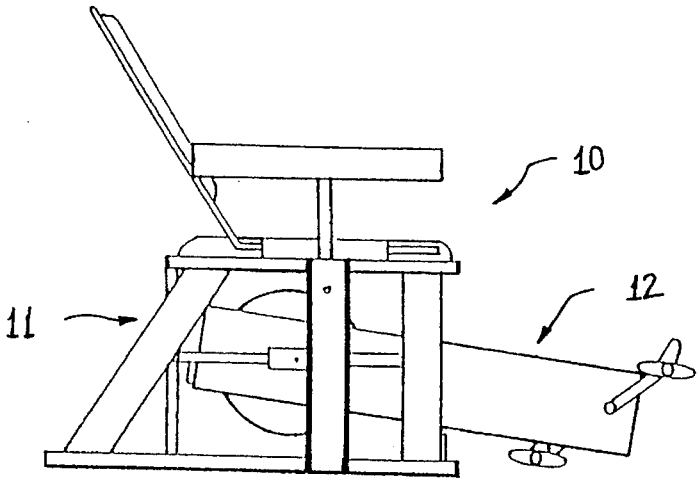

The present invention can best be seen by reference to the drawings, and in particular to FIGS. 1A through 1C. The cycling apparatus that forms the bases of the present invention is designated by the reference numeral 10. Cycling apparatus 10 comprises a structural frame unit 11 and a pedal mechanism assembly unit 12.

Figure 2A:
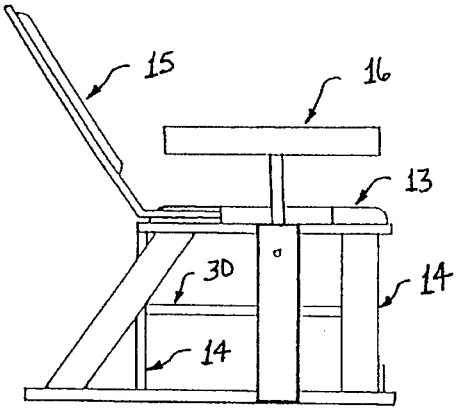
FIG. 2A is a side view of the embodiment of the structural frame unit of the adjustable cycling apparatus.
Figure 2B:
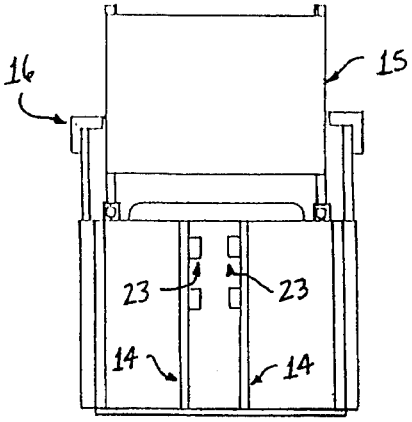
FIG. 2B is a front view of the same.
Figure 2C:
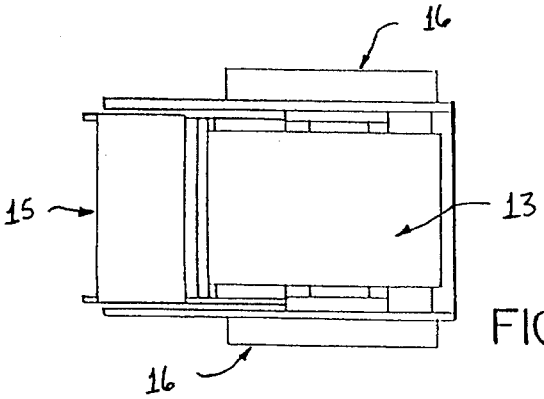
FIG. 2C is a top view of the same.

As shown in FIGS. 2A through 2C, the structural frame unit 11 comprises an adjustable seat, which includes seating means 13 from which the user operates the apparatus, a back support means 15, and an optional arm rest means 16; a rigid frame; and an assembly support for supporting and/or connecting pedal mechanism assembly unit 12 to the rigid frame of the structural frame unit 11.

Figure 3A:
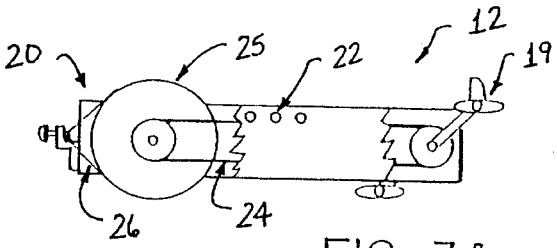
FIG. 3A is a partial cutout side view of the embodiment of the pedal mechanism assembly unit.
Figure 3B:
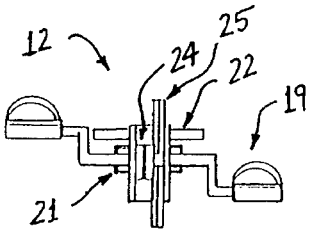
FIG. 3B is a front view of the same.
Figure 3C:
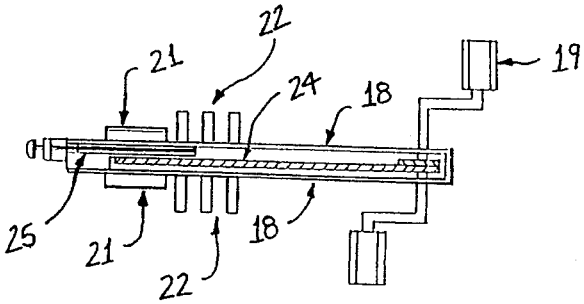
FIG. 3C is a top view of the same.
Figure 4A:
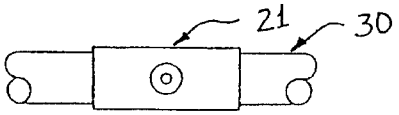
FIG. 4A is a side view displaying the attachment means which couples the pedal mechanism assembly unit with the assembly support of the structural frame unit.
Figure 4B:
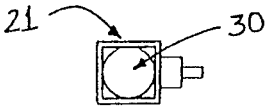
FIG. 4B is a front view of the same.
Figure 4C:
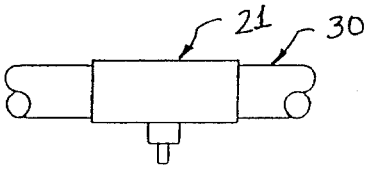
FIG. 4C is a top view of the same.

As shown in FIGS. 3A through 3C, the pedal mechanism assembly unit 12 comprises an assembly structure 18 for supporting a pedal assembly 19 and resistance means 20. Attachment means 21 is used to connect said assembly structure 18 to the assembly support of structural frame unit 11.

Resistance means 20 may be any type used in conventional cycling apparatus which increase the work necessary for a user to rotate the pedals of the pedal assembly in a cycling manner. The preferred resistance means is the flywheel type. FIG. 3A shows a pedal mechanism assembly unit employing a flywheel type resistance means. Therein the pedal assembly 19 comprises pedals and a hub to which the pedals are attached; and said resistance means 20 comprises a flywheel, a friction belt, and tension adjustment means. Said hub and flywheel are part of a conventional chain and sprocket or belt and pulley system 24, which is used to turn flywheel 25 around an axle fixed to assembly structure 18. A friction belt 26 in contact with said flywheel is tightened or loosened against the flywheel by any conventional tension adjustment means to provide variable resistance to rotational motion of the flywheel, and correspondingly to the pedals of the pedal assembly.

Optionally, an exercise data collection and display means, such as an exercise computer, may be attached. Said data collection and display means may be of any conventional type and can have inputs for collecting and/or measuring rotations per minute and resistant levels from the pedaling assembly; calculation means to process said inputs to give outputs such as work done, simulated linear speed, and/or calories consumed; and means for displaying the collected, measured, and/or calculated data.

The pedal mechanism assembly unit is moveably and pivotally coupled to the assembly support of the structural frame unit such that a portion of said pedal mechanism assembly unit is positioned within the structural frame unit. As shown in FIGS. 1A–4C, the attachment means 21 of the pedal mechanism assembly unit 12 comprises two sleeve members, whose hollow portion is of constant inner dimension, one on each side of assembly structure 18. Said sleeve members are pivotally attached to said assembly structure while maintaining a constant distance. Said sleeves may be separately or jointly rotatable. In a most preferred embodiment, the axle around which flywheel 25 turns, extends through assembly structure 18 to provide a pin upon which attachment means 21 is pivotally attached. In this embodiment of the present invention, the assembly support of the structural frame unit consists of two substantially horizontal members 30, fixedly joined at the forward and back ends by four substantially vertical members 14. Said horizontal members 30 are sized to moveably fit within the hollow of the sleeves of attachment means 21 of the pedal mechanism assembly unit. The sleeves of attachment means 21 may also contain a bearing, such as a roller or ball bearing, although neither may prove beneficial since there will be very little movement along the horizontal members 30. A great majority of the time the pedal mechanism assembly unit will be secured to the structural frame unit and remain stationary.

Figure 5A:
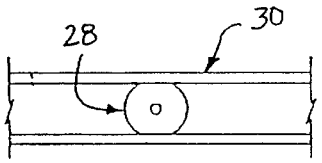
FIG. 5A is a side view displaying another version of the attachment means which couples the pedal mechanism assembly unit with the assembly support of the structural frame unit.
Figure 5B:
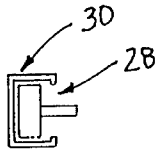
FIG. 5B is a front view of the same.
Figure 5C:
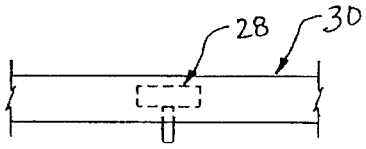
FIG. 5C is a top view of the same.
Figure 6A:
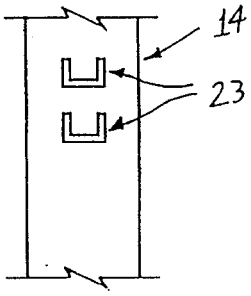
FIG. 6A is a side view displaying a portion of the substantially vertical members of the assembly support of the structural frame unit which is also used to support the pedal mechanism assembly unit.
Figure 6B:
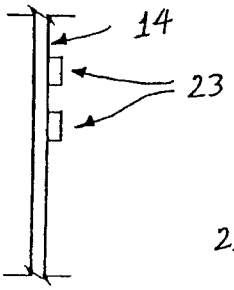
FIG. 6B is a front view of the same.
Figure 6C:
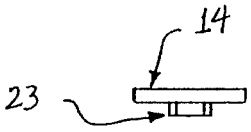
FIG. 6C is a top view of the same.

In another embodiment, the attachment means 21 of the pedal mechanism assembly unit 12 may be comprised of wheel members 28, as shown in FIGS. 5A–5C. The axle around which the flywheel turns and which extends through the assembly structure may have a wheel member 28 turnably mounted at each end, instead of the above mentioned sleeve members. The substantially horizontal member 30 may now be a type of track, rail, or channel upon which the wheel member 28 moves. The track, rail, or channel would allow for only forward and backward motion of the wheel member, not for any substantial upward or downward motion. The wheel members should prove to offer no real improvement over the sleeve members, but just demonstrates that different methods exist for moving the pedal mechanism assembly unit along the structural frame unit.

As seen in FIGS. 1A–3C and 6A–6C, substantially vertical members 14 which are located towards the front of the device are also used to support the pedal mechanism assembly unit 12. These do not have to be the same members which support the substantially horizontal members 30 as shown, but it would prove more efficient to utilize them. Mounted on the pedal mechanism assembly unit 12 may be at least one rod member 22, which extends outward on each side of assembly structure 18. Mounted on the inside of each of the front substantially vertical members 14 may be at least one bracket support member 23. Bracket support members 23 may be generally U-shaped or V-shaped brackets in which the ends of rod member 22 are placed. Because of its shape, bracket support member 23 will support the rod member and thus the pedal mechanism assembly unit in the forward, backward, and downward directions. The unit is allowed to be moved in an upward direction, which is the only desired direction. The user may lift the pedal mechanism assembly unit 12 upward, and then move the unit backward and forward along substantially horizontal supports members 30, and/or pivot the assembly, in order to reposition the same rod member in another set of brackets, or place a different rod member in the same brackets. Multiple sets of bracket members may be used with a single rod member, multiple rod members may be used with a single set of bracket members, or multiple sets of bracket members may be used with multiple rod members, all to allow the pedal assembly to be positioned at various horizontal, vertical, and angled levels.

The adjustable seat of the present invention comprises a substantially horizontal seating means, a back support means, and optionally an arm rest means, which can be adjusted to allow the user to be seated and supported at various positions in at least the forward and backward direction. These components of said adjustable seat, which are said seating means, back support means, and arm rest means, may be individually or collectively adjusted utilizing any conventional arrangement. For example, all three, two, or none of said components may be attached together rigidly, pivotally, or hingely.

In one embodiment of the present apparatus the adjustable seat comprises: a seating means 13 secured to the rigid frame; a back support means; and arm rest support means. Back support means 15 may be adjusted in a backward and forward direction. Optional arm rest support means 16 may be raised or lowered, being substantially T-shaped in the side dimension, such that the vertical portion of said arm rest means is respectively, to a lesser or greater extent, contained in a vertical sleeve of the rigid frame.

In other embodiments, seating means and back support means may be attached to each other, and may be together moved in a forward or backward direction. The optional arm rest means may be the same in the embodiment above, or in the alternative be pivotally attached to the back support, in a conventional manner.

In all embodiments the adjustable seat moves to accommodate the range in size of intended users, as well as to compensate for different positions of the pedal mechanism assembly unit, but will stay fixed during the actual cycling exercise. Movement of the seating means, in a forward or backward direction with respect to the rigid frame, is accomplished through any appropriate means and are preferably through: 1) guiding rails fixed to the rigid frame and glides or wheels fixed to a substantially horizontal portion of the back support means or back support/seating means, or 2) a pair of sleeves fixed to the rigid frame and a portion of the back support means or back support/seating means comprising two horizontal members sized to slideably move within said sleeves; wherein said horizontal portion or members may be optionally hingedly attached to the rest of the back support means. Optionally, friction applying means such as a screw may be utilized through any sleeve supra which allows variation of the friction between said sleeve and the slideable member within the sleeve.

Figure 7A:
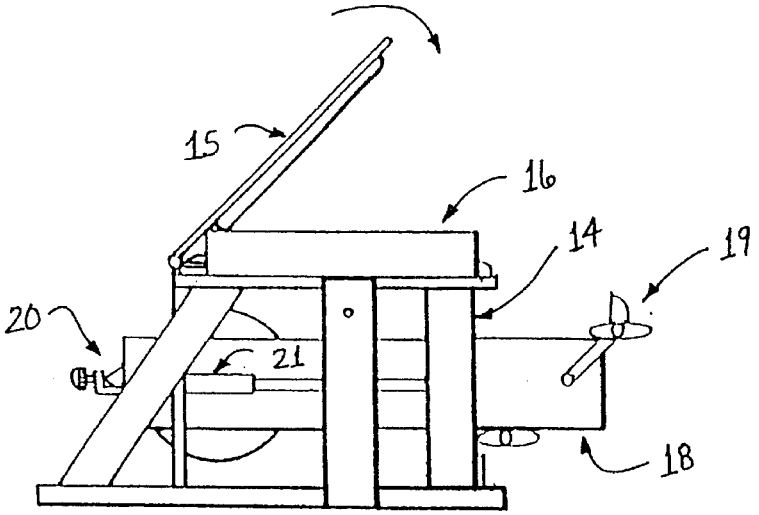
FIG. 7A is a side view which shows the collapseability of the present invention.

As shown in FIGS. 7A, the present apparatus may be collapsed into a more compact form for storage purposes. Pedal mechanism assembly unit 12 may be moved under the adjustable seat, within the structural frame unit 11, to significantly reduce the overall length of the apparatus. In one embodiment, back support means 15 may be folded downward and arm rest support means 16 may be lowered, both of which will reduce the overall height of the apparatus. Alternatively, back support means 15 may be removed from contact with the rigid frame, inverted, and replaced.

Figure 7B:
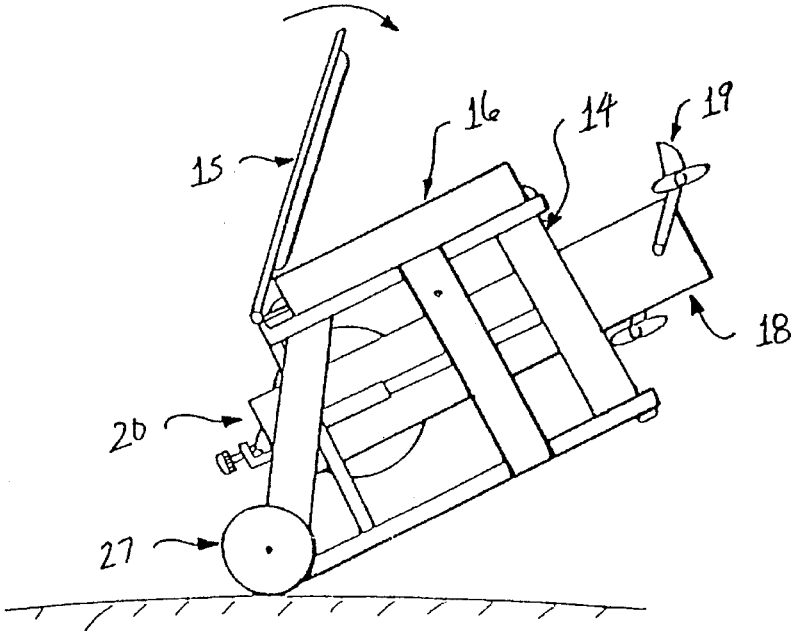
FIG. 7B is a side view which shows the present apparatus equipped with wheels.

Wheel assemblies may optionally be attached to the rigid frame of the structural frame unit in any appropriate manner to allow the present apparatus to be thereupon transported. These wheel assemblies are of any conventional type, and are either removeable or have conventional means for locking the wheels such that, in one state, rotational motion of said wheels is substantially blocked, and in another, said wheels are free to rotate. Preferrably at least two such wheel assemblies are attached to the lower portion of the rigid frame. FIG. 7B show conventional wheel assemblies 27 attached to the rigid frame of the present invention.

It is to be understood that the present invention is not limited to the sole embodiment described above, but encompasses any and all embodiments within the scope of the following claims.

I claim:

1. An adjustable cycling apparatus which comprises:

a structural frame unit comprising a rigid frame, an seat mounted on said rigid frame and having a back support means moveable along said rigid frame in a generally horizontal direction, and an assembly support;

a pedal mechanism assembly unit having a pedal assembly and attachment means, wherein said assembly unit is coupled to said assembly support of said structural frame unit to be pivoted in either the upward or downward direction, the point of pivot of said assembly unit being moveable in a substantially horizontal direction along said assembly support, such that said pedal assembly of said pedal mechanism assembly unit can be positioned at various locations;

whereby said apparatus may be used to participate in defined lower body exercise routines while in a seated position.

2. An adjustable cycling apparatus as claimed in claim 1, wherein said adjustable seat further comprising a horizontal seat means fixedly mounted on said rigid frame.

3. A flexible cycling apparatus as claimed in claim 1, wherein said pedal mechanism assembly unit further comprises:

an assembly structure; and resistance means;

wherein said pedal assembly comprises pedals connected to a hub; said hub and said resistance means are enclosed in the assembly structure; and said attachment means are on the exterior of the assembly structure;

whereby a user rotating said pedals rotates said hub against said resistance from said resistance means.

4. A flexible cycling apparatus as claimed in claim 3, wherein said resistance means further comprises a flywheel, a friction belt, and a chain and sprocket system, such that said flywheel is connected to said hub of said pedal assembly through said chain and sprocket system.

whereby a user turning said pedals rotates said flywheel against said friction belt through said chain and sprocket system.

5. A flexible cycling apparatus as claimed in claim 4 further comprising an axle fixed to said assembly structure, said axle passing through the center of said flywheel and said assembly structure, wherein;

said attachment means comprises two sleeve members being pivotally attached to said assembly structure on said axle such that each sleeve member can be rotated, and said flywheel rotates around said axle.

6. A flexible cycling apparatus as claimed in claim 5 further comprising at least one rod member fixedly mounted to said assembly structure, the rod member having end segments which extend out both sides of said assembly structure.

7. A flexible cycling apparatus as claimed in claim 6 wherein said assembly support of the structural frame unit comprises two substantially horizontal members and four substantially vertical members, wherein said substantially horizontal support members are fixedly joined at the forward and backward ends to said substantially vertical members and said horizontal members are sized to slideably fit within the hollow of said sleeve members of said attachment means of said pedal mechanism assembly unit.

8. A flexible cycling apparatus as claimed in claim 7, wherein said substantially vertical members which are fixedly joined to the forward ends of said substantially horizontal members have U-shaped brackets along the inside for supporting said rod members of said pedal mechanism assembly unit.

9. A flexible cycling apparatus which comprises:

a structural frame unit comprising a rigid frame, a seat mounted on said rigid frame and having a back support means moveable along said rigid frame in a substantially horizontal direction, and an assembly support;

a pedal mechanism assembly unit having a pedal assembly and attachment means, wherein said assembly unit is coupled to said assembly support of said structural frame unit to be pivoted in either the upward or downward direction, the point of pivot being moveable along said assembly support in a substantially horizontal direction;

wherein said apparatus is collapseable into a more compact configuration by positioning said pedal mechanism assembly unit such that at least a majority of said assembly unit is within said structural frame unit.

* * * * *